US009757782B2

(12) United States Patent
Wilkinson

(10) Patent No.: US 9,757,782 B2
(45) Date of Patent: Sep. 12, 2017

(54) FREELY ROTATING MAGNETIC TIP WITH SURFACE TRACE FOR DENT REMOVAL ROD

(76) Inventor: Alan Wilkinson, Madrid (ES)

( * ) Notice: Subject to any disclaimer, the term of this patent is extended or adjusted under 35 U.S.C. 154(b) by 311 days.

(21) Appl. No.: 13/640,730

(22) PCT Filed: Mar. 29, 2011

(86) PCT No.: PCT/GB2011/000440

§ 371 (c)(1),
(2), (4) Date: Oct. 11, 2012

(87) PCT Pub. No.: WO2011/128614

PCT Pub. Date: Oct. 20, 2011

(65) Prior Publication Data

US 2013/0025336 A1 Jan. 31, 2013

(30) Foreign Application Priority Data

Apr. 14, 2010 (GB) ..... 1006172.9

(51) Int. Cl.

| | |
|---|---|
| ***B21D 1/06*** | (2006.01) |
| ***B21D 1/12*** | (2006.01) |
| *B21D 1/08* | (2006.01) |
| *B21D 1/14* | (2006.01) |
| *B21D 1/10* | (2006.01) |

(52) U.S. Cl.

CPC ..... *B21D 1/06* (2013.01); *B21D 1/12* (2013.01); *B21D 1/08* (2013.01); *B21D 1/10* (2013.01); *B21D 1/14* (2013.01); *Y10S 72/705* (2013.01)

(58) Field of Classification Search

CPC ... B21D 1/06; B21D 1/12; B21D 1/14; B21D 1/08; B21D 1/10; Y10S 72/705

USPC ..... 72/6.1, 28.1, 31.01, 31.1, 37, 48, 54, 64, 72/66, 67, 184, 199, 362, 380, 404, 411, 72/412, 417, 418, 419, 42, 462, 483, 707, 72/705, 430, 379.2, 75, 31.09, 479, 478, 72/481.1

See application file for complete search history.

(56) References Cited

U.S. PATENT DOCUMENTS

| | | | | |
|---|---|---|---|---|
| 3,478,558 A * | 11/1969 | Miller et al. | ..... | 72/199 |
| 4,754,637 A * | 7/1988 | O'Dell | ..... | 72/430 |
| 4,947,668 A * | 8/1990 | Ostertag | ..... | 72/75 |

(Continued)

FOREIGN PATENT DOCUMENTS

| | | | | |
|---|---|---|---|---|
| DE | 10217003 A1 * | 11/2003 | ..... | B21D 1/06 |
| EP | 0595593 A1 | 5/1994 | | |

OTHER PUBLICATIONS

DE 10217003A1 machine translation from EPO webpage.*

(Continued)

*Primary Examiner* — R. K. Arundale
*Assistant Examiner* — Pradeep C Battula
(74) *Attorney, Agent, or Firm* — Pyprus Pte Ltd

(57) ABSTRACT

The current invention refers to a paintless dent removal tip having a rare earth magnetic sphere which is free to rotate within a mounting cup and attach itself to the inside of a motor vehicle panel at a point on the magnet dictated by its polarity, so that maximum magnetic flux attracts a ferro-magnetic ball trace on the panel's outer surface, indicating the exact position of the part of the magnet touching the panel, regardless of the angle at which the tip is held, and so showing the user where to apply pressure to remove a dent.

6 Claims, 2 Drawing Sheets

(56) References Cited

U.S. PATENT DOCUMENTS

| | | | | |
|---|---|---|---|---|
| 5,445,000 | A * | 8/1995 | Brown | 72/31.01 |
| 5,461,900 | A * | 10/1995 | Gutierrez | B21D 1/06 72/479 |
| 5,596,896 | A * | 1/1997 | Snell | 72/75 |
| 7,124,617 | B2 * | 10/2006 | Satterlee | B21D 1/06 72/430 |
| 8,601,659 | B2 * | 12/2013 | Prevey | B24B 39/003 29/407.08 |
| 2002/0112517 | A1 | 8/2002 | Akins | |
| 2004/0134255 | A1 * | 7/2004 | Satterlee et al. | 72/479 |
| 2009/0049885 | A1 * | 2/2009 | Postma | 72/379.2 |

OTHER PUBLICATIONS

International Search Report of international patent application No. PCT/GB2011/000440 completed on Sep. 26, 2011 and mailed Oct. 5, 2011 (2 pages).

Search Report of corresponding British patent application No. GB1006172.9 dated Sep. 27, 2010 (1 page).

* cited by examiner

FREELY ROTATING MAGNETIC TIP WITH SURFACE TRACE FOR DENT REMOVAL ROD

The present application refers to a paintless dent removal tool tip and trace to remove dents from painted sheet metal surfaces especially where the paint has not been damaged.

Currently, paintless dent repair tools, which remove dents by applying pressure to the inside surface of sheet metal, typically a vehicle panel, are comprised of metal rods or bars of differing lengths, shapes and tips to facilitate access to varying positions, allowing the specialist to push the dent out from the inside whilst viewing the panel from the outside, highlighting the dent with a light or reflector panel.

The difficulties associated with this technique particularly for users anything less than well practised are: unsurity of knowing exactly where the tool tip is located, leading to panel damage if pressure is exerted when tip is not correctly positioned, slippage of tool tip away from desired position when pressure is applied, damage to interior surface of a visible panel through dragging or scraping of tool tip for tip location purposes and excessive time needed for dent removal.

Patent applications US2009/0049885 and EP0595593 propose the use of fixed rare earth magnets as, or incorporated into a tip. Maximum magnetic flux is present at two specific points on the magnetic sphere, ie its poles. These designs will give a precise tip position if held at one specific angle ie where the magnet's polarity is in direct contact with the panel but if the pdr bar is tilted, as occurs in the nature of massaging the metal to remove the dent, so that the polarity point does not touch the panel, then an erroneous position will be given by the magnetic dust or steel ball and the user may be led to cause undesired high spots, particularly when finishing a dent.

To overcome these problems the current invention refers to a freely rotating rare earth magnetic sphere tip of sufficient magnetic force that when moved on the inside surface, it attracts a metallic trace in the form of a ferromagnetic ball on the outside surface which follows the exact position of the tool tip. Precise positioning is achieved because the spherical magnet will rotate to position and attach itself to the work piece according to its polarity, where maximum magnetic flux attracts the ferromagnetic ball trace directly above the tool tip.

A description of a possible form of realisation will now be given referring to the following drawings where:

Figure 3A:
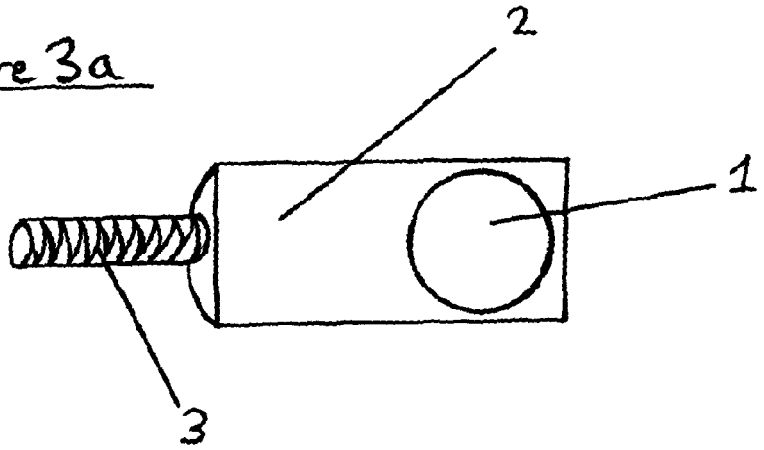
Figure 3B:
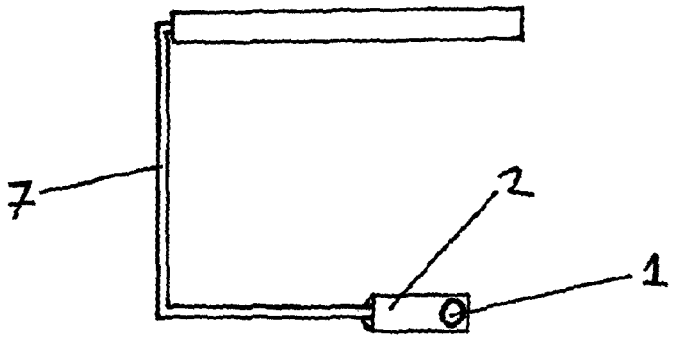
Figure 3C:
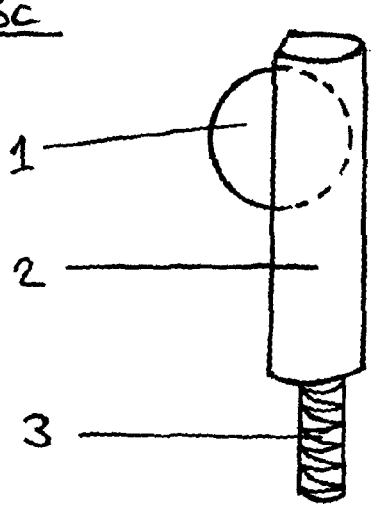

FIGS. 3*a*, 3*b* and 3*c* show a magnetic tip adapted for limited access.

Figure 1:
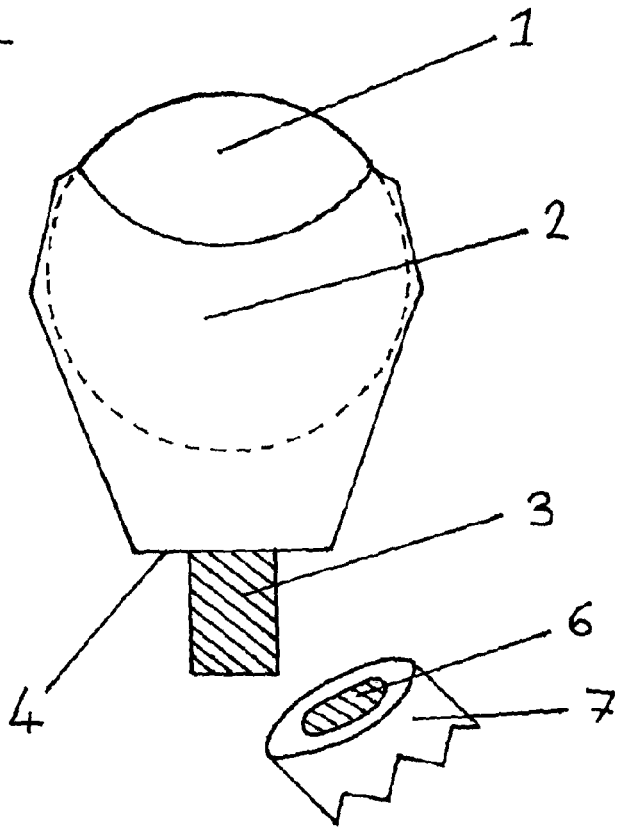
FIG. 1 shows the magnetic tip and its attachment to a pdr rod

Referring to FIG. 1, the magnetic tip is comprised of a rare earth magnetic sphere (1) measuring between 10 and 19 mm diameter according to thickness of panel and tip size required. The sphere (1) is mounted in a non-magnetically attracted cup, for example a plastic (2) in such away that the sphere is free to rotate in all axes, protrudes the maximum possible but is secured within cup (2). Non-magnetically affected threaded metal shaft (3) is fixed into body of cup (2) and protrudes though the base of (2). It screws precisely into threaded hole (6) at extreme of tool bar (7), butting up against flat surface (4) of cup (2), allowing no movement of the magnetic tip assembly in relation to the tool bar.

Cup (2) is of a length to support magnetic sphere (1) at a sufficient distance from end of bar (7) so as not to interfere with the magnetic polarity of (1) ie so that the magnetic flux is at a maximum at whatever point it touches the panel. Trace ferromagnetic ball (9) may be moved periodically out of the dented area via movement of bar (7) to allow the user a better view of the dent removal progress.

Figure 2:
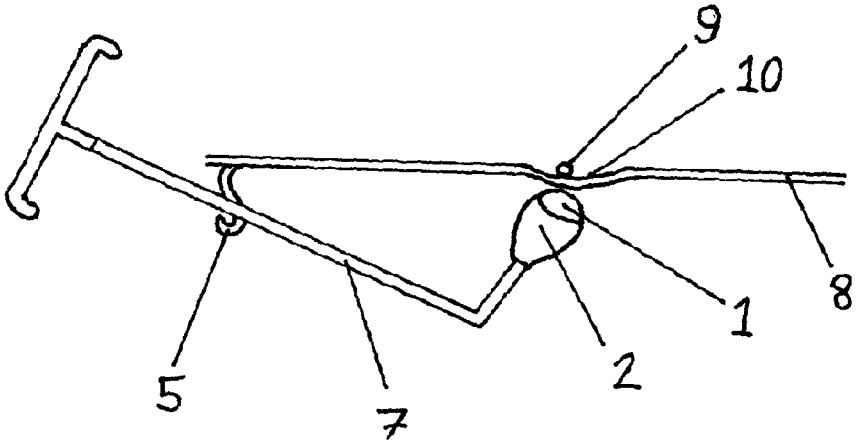
FIG. 2 shows position of trace relative to tip on a panel cross-section.

In FIG. 2, trace (9) is shown on a cross-section of a panel, comprised of a ferromagnetic ball measuring between 3 mm and 5 mm diameter. The non-magnetised nature of (9) increases the accuracy of the tool tip location, (in relation to a magnetised trace ferromagnetic ball), so when pressure is applied to tool tip, said pressure is transmitted to the panel directly beneath the centre of trace (9). (Trace 9 may be lightly magnetised to reduce risk of loss and aid initial positioning). As tool bar (7) is levered via "S" hook (5) on inside of panel (8) the user positions trace (9) near the dent (10).

According to established pdr pressure pattern techniques the dent is gradually pushed out by exerting leveraged pressure on the sphere (1) via tool bar (7). All movements of sphere (1) are indicated by trace (9), the user knowing exactly where the tool tip is at all times.

FIG. 3*a* shows a flattened tip body (2) with sphere (1) mounted so that pressure is applied to the panel via lateral movement of pdr door rod (7) as seen in FIG. 3*b*. Cup (2) is flattened to aid limited access to interior of panel, typical of the majority of door designs.

FIG. 3*c* shows a side view of the tip adapted to door repairs, the tip attaching to the rod via threaded shaft (3)

A variety of mounting angles and sizes of freely rotating rare earth magnetic spheres (1) in non-magnetically affected mounting cups (2), is provided to the user to access the greatest number of dent positions and panel gauges.

The invention claimed is:

1. A paintless dent removal tool for applying pressure to a motor vehicle panel comprising a tool bar, a non-magnetically affected mounting cup attached to an end of the tool bar, a rare earth magnetic sphere, and a ferromagnetic ball trace, the rare earth magnetic sphere being secured within the non-magnetically affected mounting cup and being free to rotate in all axes within the non-magnetically affected mounting cup, the rare earth magnetic sphere being attachable to an inside surface of the motor vehicle panel; and the ferromagnetic ball trace being attracted to the rare earth magnetic sphere on an outer surface of the motor vehicle panel, thereby indicating an exact position of a part of the rare earth magnetic sphere touching the inside surface of the motor vehicle panel irrespective of an angle of the tool bar and non-magnetically affected mounting cup to the inside surface of the motor vehicle panel, the part being a pole of the rare earth magnetic sphere with maximum magnetic flux, showing where to apply pressure to remove a dent;

in use, the rare earth magnetic sphere rotating and attaching to the inside surface of the motor vehicle panel according to a polarity of the rare earth magnetic sphere.

2. A paintless dent removal tool as claimed in claim 1, in which the non-magnetically affected mounting cup secures the rare earth magnetic sphere with a substantial proportion of the rare earth magnetic sphere protruding whilst still retaining the rare earth magnetic sphere within the non-magnetically affected mounting cup, maximizing the range of angles at which the tool is usable in relation to the motor vehicle panel.

3. A paintless dent removal tool as claimed in claim 1, in which the non-magnetically affected mounting cup secures the rare earth magnetic sphere at a distance from the tool bar via a non-magnetically affected thread metal shaft, the tool bar being metal, so that the polarity of the rare earth magnetic sphere is unaffected by the tool bar and the rare earth magnetic sphere is free to rotate when presented to the inside surface of the motor vehicle panel.

4. A paintless dent removal tool as claimed in claim 1, in which the ferromagnetic ball trace measures between 3 mm and 5 mm in diameter and is used as a surface trace on the outer surface of the motor vehicle panel, the ferromagnetic ball trace being of a size that can roll across the outer surface of the motor vehicle panel without jumping when following the position of the rare earth magnetic sphere.

5. A paintless dent removal tool as claimed in claim 1, in which the non-magnetically affected mounting cup is flattened for use where there is limited access to the inside of the motor vehicle panel.

6. A paintless dent removal tool as claimed in claim 1, in which the ferromagnetic ball trace is smaller than the rare earth magnetic sphere.

* * * * *